US007461743B2

(12) United States Patent
Taft

(10) Patent No.: US 7,461,743 B2
(45) Date of Patent: Dec. 9, 2008

(54) COSMETICS CONTAINER WITH INTEGRATED NAIL FILE

(76) Inventor: Camilla A. Taft, 282 Lincoln Ave., #B, Hawthorne, NJ (US) 07506

( * ) Notice: Subject to any disclaimer, the term of this patent is extended or adjusted under 35 U.S.C. 154(b) by 407 days.

(21) Appl. No.: 10/770,825

(22) Filed: Feb. 3, 2004

(65) Prior Publication Data

US 2005/0166937 A1 Aug. 4, 2005

(51) Int. Cl.
*A65D 29/00* (2006.01)

(52) U.S. Cl. ..... 206/581; 132/73.5; 132/73; 132/76.4

(58) Field of Classification Search ..... 132/73, 132/73.5, 76.4, 76.5; 206/581, 38
See application file for complete search history.

(56) References Cited

U.S. PATENT DOCUMENTS

| | | | | | |
|---|---|---|---|---|---|
| 2,888,020 | A | * | 5/1959 | Schultz | 132/73.5 |
| 4,058,132 | A | * | 11/1977 | Dietz | 132/73 |
| 4,381,792 | A | * | 5/1983 | Busch et al. | 132/75.6 |
| D397,517 | S | * | 8/1998 | Choyee | D28/61 |
| 5,815,930 | A | * | 10/1998 | Kojima | 30/294 |
| 6,155,270 | A | * | 12/2000 | Samiean | 132/73 |

* cited by examiner

*Primary Examiner*—David T Fidei
(74) *Attorney, Agent, or Firm*—Watov & Kipnes, P.C.

(57) ABSTRACT

A cosmetic container includes a nail grooming structure on the container. For example, a nail polish cap includes an integral nail file. For example, the nail file may be made from a flexible sheet having a roughened surface on one side and an adhesive backing on the other. The nail polish cap may include a recessed portion with the flexible nail file affixed thereto.

9 Claims, 2 Drawing Sheets

COSMETICS CONTAINER WITH INTEGRATED NAIL FILE

The invention relates to cosmetic containers such as nail polish containers, lipstick cases, compacts, cosmetic pens and the like. More particularly, the invention relates to novel cosmetic containers including nail grooming structures integrated on the cosmetic containers.

BACKGROUND AND RELATED ART

Both cosmetic containers and nail grooming structures are well known in the art. However, it is not always practical or convenient to carry a nail file. Also, nail files have a tendency to be misplaced. What is needed is a more practical and convenient nail file.

BRIEF DESCRIPTION OF THE DRAWINGS

Various features of the invention will be apparent from the following description of preferred embodiments as illustrated in the accompanying drawings, in which like reference numerals generally refer to the same parts throughout the drawings. The drawings are not necessarily to scale, the emphasis instead being placed upon illustrating the principles of the invention.

DESCRIPTION

In the following description, for purposes of explanation and not limitation, specific details are set forth such as particular structures, interfaces, techniques, etc. in order to provide a thorough understanding of the various aspects of the invention. However, it will be apparent to those skilled in the art having the benefit of the present disclosure that the various aspects of the invention may be practiced in other examples that depart from these specific details. In certain instances, descriptions of well known devices, structures, and methods are omitted so as not to obscure the description of the present invention with unnecessary detail.

Figure 1:
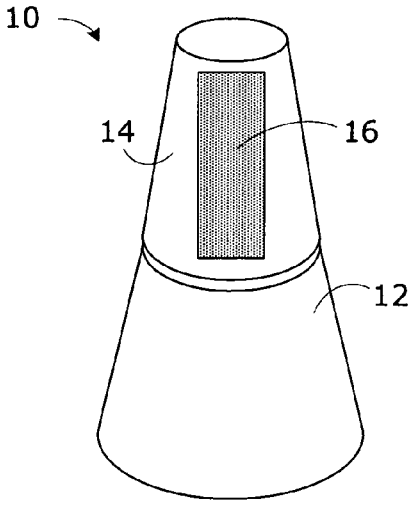
FIG. 1 is a perspective view of an example of a cosmetic container including an integrated nail grooming structure, according to some embodiments of the invention.

With reference to FIG. 1, a cosmetic container 10 includes a bottle 12 and a cap 14 with a nail grooming structure 16 on the cap 14. For example, the cosmetic container 10 is a nail polish container and the nail grooming structure 16 is a nail file. For example, integrated onto the side of a nail polish cap is a nail file with adhesive backing.

Non-limiting example of cosmetic containers include nail polish bottles, lipstick cases, cosmetic pens, and compacts. Non-limiting examples of nail grooming structures includes nail files (in any of several grades and styles), buffers, and/or emery boards.

The nail grooming structures described herein may be provided by any suitable manufacturing techniques. For example, for a plastic cap 14, the nail file 16 may be molded with the cap 14 by providing a section of the mold that creates a corresponding roughened section on the cap 14 suitable for use as a nail file.

It is easier to locate a nail file when it is placed onto a cosmetic container that is used on a daily basis and is usually found in a woman's purse. In the case of a nail varnish bottle, the extra advantage of applying a nail file is that the motion of filing a nail also acts to agitate the product before use.

According to some embodiments, a flexible sheet includes a first side suitable for use as a nail file and a second adhesive side opposite the first side. For example, the flexible sheet has a roughened surface on one side and peel-and-stick type adhesive surface on the other side. For example, the roughened surface may correspond to a desired grit of sandpaper. The flexible sheet may then be secured to the cap 14 with the adhesive side. An advantage of this aspect of the invention is that the flexible sheet may be sold separately so that the consumer can retro-fit the nail file onto an cosmetic container they already own. For example, the separately sold nail file can include a peel-and-stick backing that the consumer can remove to position the nail file on either the outside or inside of a favorite compact.

According to some embodiments of the invention, a separately sold kit may include a nail grooming structure including a flexible sheet having a first side suitable for use as the nail grooming structure and a second adhesive side opposite the first side. The kit may further include indicia providing instructions for the user to affix the nail grooming structure to a cosmetics container. The kit may include a plurality of nail grooming structures including, for example, a variety of different nail grooming structures such as nail files (in any of several grades and styles), buffers, and/or emery boards.

Figure 2:
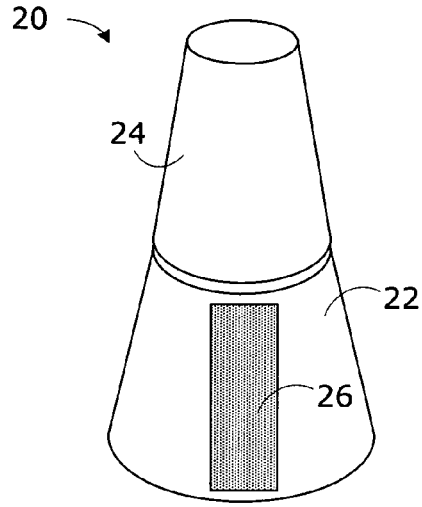
FIG. 2 is a perspective view of another example of a cosmetic container including an integrated nail grooming structure, according to some embodiments of the invention.

With reference to FIG. 2, a cosmetic container 20 includes a bottle 22 and a cap 24 with a nail grooming structure 26 on the bottle 22. For example, the cosmetic container 20 is a nail polish container and the nail grooming structure 26 is a nail file. Alternatively, the bottle 22 may contain nail polish remover or other types of nail treatments. As noted above, the nail grooming structures described herein may be provided by any suitable manufacturing techniques. For example, for a glass bottle 12, the nail file 26 may be molded with the bottle 12 by providing a section of the mold that creates a corresponding roughened section on the bottle suitable for use as a nail file. In addition or alternatively, the nail file 26 may be machined, sand blasted, or etched.

Figure 3:
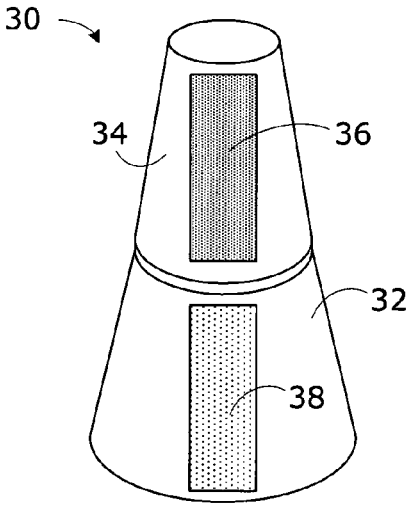
FIG. 3 is a perspective view of another example of a cosmetic container including an integrated nail grooming structure, according to some embodiments of the invention.

With reference to FIG. 3, some embodiments of the invention may include more than one integrated nail grooming structure. A cosmetic container 30 includes a bottle 32 and a cap 34 with a first nail grooming structure 36 on the cap 34 and a second nail grooming structure on the bottle 22. For example, the cosmetic container 30 is a nail polish container, the first nail grooming structure 36 is a nail file, and the second nail grooming structure 38 is a buffer.

Figure 4:
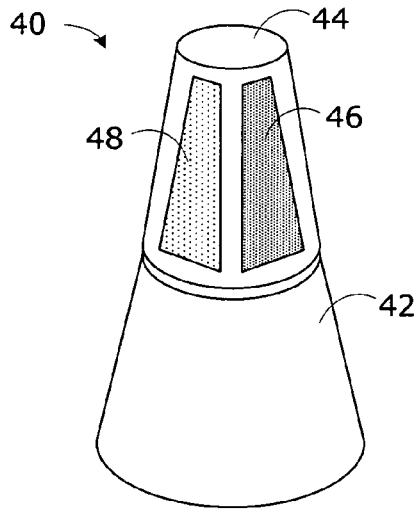
FIG. 4 is a perspective view of another example of a cosmetic container including an integrated nail grooming structure, according to some embodiments of the invention.

With reference to FIG. 4, a cosmetic container 40 includes a bottle 42 and a cap 44 with a first nail grooming structure 46 on the cap 44 and a second nail grooming structure on the cap 44. For example, the cosmetic container 40 is a nail polish container, the first nail grooming structure 46 is a medium grade nail file, and the second nail grooming structure 48 is a high grade nail file. Other non-limiting examples for the first and second nail grooming structures include:

Regular nail file (low, medium, or high grade) AND glass file;

Regular nail file (low, medium, or high grade) AND acrylic file;

Regular nail file (low, medium, or high grade) AND buffer file;

Acrylic file AND buffer file;

Regular nail file (low grade) AND Regular nail file (medium or high grade);

Regular nail file (medium grade) AND Regular nail file (low or high grade);

Regular nail file (high grade) AND Regular nail file (low or medium grade);

Glass file AND buffer file;

Glass file AND acrylic file.

Figure 5:
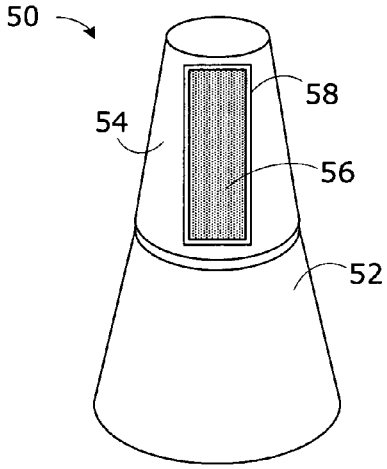
FIG. 5 is a perspective view of another example of a cosmetic container including an integrated nail grooming structure, according to some embodiments of the invention.

With reference to FIG. 5, some embodiments of the invention may include a recessed portion adapted to receive the nail grooming structure. A cosmetic container 50 includes a bottle 52 and a cap 54 with a nail grooming structure 56 on the cap 54. For example, the cosmetic container 50 is a nail polish container and the nail grooming structure 56 is a nail file. The cap 54 includes a recessed portion 58 sized to receive the nail file 56. The recessed portions described herein may be provided by any suitable manufacturing techniques. For example, for either glass or plastic structures, the recessed portion may be provided by a suitable mold. The nail grooming structure may then be positioned in the recessed portion and affixed by any suitable means. For example, a flexible sheet of sandpaper may include an adhesive backing which may be adhered to the recessed portion. Alternatively, a metal nail file may be glued or snap fit into the recessed portion.

Figure 6:
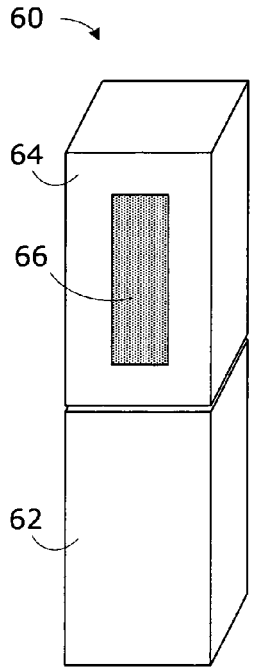
FIG. 6 is a perspective view of another example of a cosmetic container including an integrated nail grooming structure, according to some embodiments of the invention.

With reference to FIG. 6, a cosmetic container 60 includes a base container 62 and a cap 64 with a nail grooming structure 66 on the cap 64. For example, the cosmetic container 60 is a lipstick case and the nail grooming structure 66 is a nail file.

Figure 7:
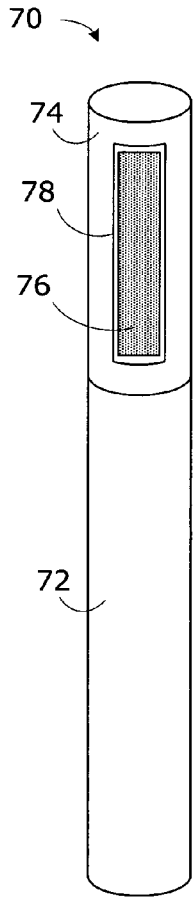
FIG. 7 is a perspective view of another example of a cosmetic container including an integrated nail grooming structure, according to some embodiments of the invention.

With reference to FIG. 7, a cosmetic container 70 includes a base container 72 and a cap 74 with a nail grooming structure 76 on the cap 74. For example, the cosmetic container 70 is a cosmetic pen and the nail grooming structure 76 is a nail file.

Figure 8:
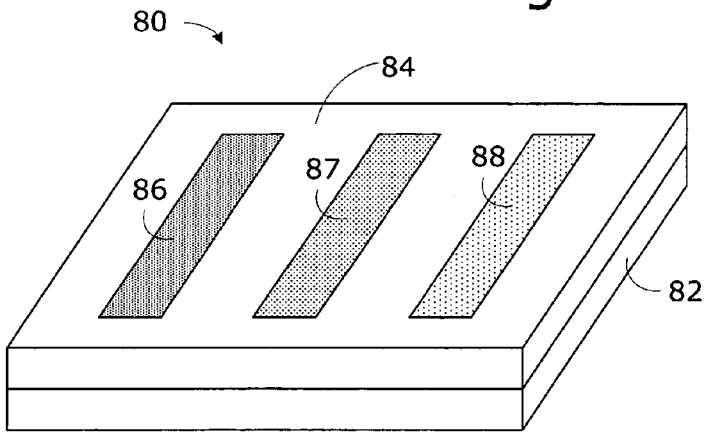
FIG. 8 is a perspective view of another example of a cosmetic container including an integrated nail grooming structure, according to some embodiments of the invention.

With reference to FIG. 8, a cosmetic container 80 includes a base container 82 and a lid 84 with three nail grooming structures 86, 87, and 88 on the lid 84. For example, the cosmetic container 80 is a compact and the three nail grooming structures include a high grade nail file 86, a medium grade nail file 87, and a nail buffer 88. For example, the compact 80 may contain cosmetics such as eye shadow, blush, or pressed powder. In some embodiments, some or all of the nail grooming structures may be provided inside the compact, for example, on an outside surface of the lid 84 or on the outside surface of base container 82.

The foregoing and other aspects of the invention are achieved individually and in combination. The invention should not be construed as requiring two or more of the such aspects unless expressly required by a particular claim. Moreover, while the invention has been described in connection with what is presently considered to be the preferred examples, it is to be understood that the invention is not limited to the disclosed examples, but on the contrary, is intended to cover various modifications and equivalent arrangements included within the spirit and the scope of the invention.

What is claimed is:

1. An apparatus, comprising:

a cosmetic container having a nail grooming structure receiving surface; and at least one nail grooming structure affixed to the nail grooming structure receiving surface and comprising a flexible substrate having a front surface and rear surface, said rear surface having an adhesive thereon for securing the substrate to the nail grooming structure receiving surface said front surface having a roughened surface comprising a layer of sandpaper.

2. The apparatus of claim 1, wherein the cosmetic container is a nail polish container.

3. The apparatus of claim 2, wherein the nail grooming structure includes a nail file.

4. The apparatus of claim 2, wherein the nail grooming structure is disposed on a cap portion of the nail polish container.

5. The apparatus of claim 1 wherein the cosmetic container comprises a recess for receiving the flexible substrate.

6. A kit, comprising:

a cosmetic container having a nail grooming structure receiving surface; and at least one flexible substrate having a front surface and a rear surface, said rear surface having an adhesive thereon for securing the substrate to the nail grooming structure receiving surface, and said front surface having a roughened surface comprising a layer of sandpaper.

7. The kit of claim 6, wherein the cosmetic container is a nail polish container.

8. The kit of claim 7, wherein the nail grooming structure is disposed on a cap portion of the nail polish container.

9. The kit of claim 6, wherein the cosmetic container comprises a recess for receiving the flexible substrate.

* * * * *